US005382217A

United States Patent [19]

Namowitz

[11] Patent Number: 5,382,217

[45] Date of Patent: Jan. 17, 1995

[54] SYSTEM FOR BREAKING IN CREASES OF A BOX BLANK

[75] Inventor: Hermann Namowitz, Brüggen, Germany

[73] Assignee: Jagenberg Aktiengesellschaft, Dusseldorf, Germany

[21] Appl. No.: 127,260

[22] Filed: Sep. 24, 1993

[30] Foreign Application Priority Data

Oct. 1, 1992 [DE] Germany ..... 4232956

[51] Int. Cl.[6] ..... B31B 1/78

[52] U.S. Cl. ..... 493/310; 493/408; 493/409

[58] Field of Search ..... 493/309, 310, 311, 312, 493/408, 409; 53/566, 458

[56] References Cited

U.S. PATENT DOCUMENTS

| | | | |
|---|---|---|---|
| 3,326,096 | 6/1967 | Mendoza . | |
| 4,468,214 | 8/1984 | Grundler | 493/182 |
| 4,530,692 | 7/1985 | Williams | 493/309 |
| 4,588,393 | 5/1986 | Cogswell et al. . | |
| 4,994,011 | 2/1991 | Reil | 493/309 |

FOREIGN PATENT DOCUMENTS

| | | | |
|---|---|---|---|
| 7535377 | 11/1976 | France | 493/309 |
| 1101926 | 3/1961 | Germany . | |
| 1173783 | 7/1964 | Germany . | |

*Primary Examiner*—Jack W. Lavinder
*Attorney, Agent, or Firm*—Herbert Dubno; Andrew Wilford

[57] ABSTRACT

A box tube blank having first, second, third, and fourth panels joined together at first, second, third, and forth creases is broken in starting with the blank oriented in a starting plane with the first and third creases superposed and the second and fourth creases outermost. First the second and fourth creases are pressed toward each other parallel to the starting plane to spread the first and third creases away from each other until the second and fourth creases are juxtaposed and the first and third creases lie outermost and the blank lies generally perpendicular to the starting plane. Then the tube blank passes between an upstream pair of parallel rollers extending perpendicular to the starting plane to compress it parallel to the starting plane. Thereafter the first and third creases are pressed toward each other perpendicular to the starting plane to spread the second and fourth creases away from each other until the first and third creases are juxtaposed and the second and fourth creases lie outermost and the blank lies generally parallel to the starting plane. The tube blank then passes between a downstream pair of parallel rollers extending parallel to the starting plane to compress it perpendicular to the starting plane.

11 Claims, 2 Drawing Sheets

SYSTEM FOR BREAKING IN CREASES OF A BOX BLANK

FIELD OF THE INVENTION

The present invention relates to the breaking-in of the longitudinal folds or creases of a parallepipedal box blank. More particularly this invention concerns a method of and apparatus for breaking in such folds.

BACKGROUND OF THE INVENTION

A standard waterproof box is mainly formed of a polyethylene-coated cardboard sheet that is given to start with four parallel longitudinal creases subdividing it into four adjacent relatively wide side panels and one fairly narrow end seal flap. A so-called tube blank is first made by holding the blank flat heating the seal flap and then folding in one side at the crease to lay the end flap and the adjacent fourth side panel while still coplanar on top of the second and third side panels. Then the first panel is heated and folded in and its outer edge portion is pressed down on the heated seal flap with the outer edge lying directly on the fourth seam between the fourth panel and the seal flap. This forms a watertight seal between the seal flap and the first panel and creates the flat tube blank where the first and fourth panels lie atop the second and third panels, respectively.

Subsequently the tube blank is opened up to give it a rectangularly tubular shape, and one end of the opened-up blank is closed and the blank is stood on this closed end to form an upwardly open container or vessel. Then the contents are filled into the thus formed container and its upper end is closed.

In order to facilitate such subsequent handling of the flat tube blank it is standard practice to break in the creases, that is fold them back and forth so that they are not too stiff. This is typically done by holding the flat tube blank down on a conveyor belt with suction applied only to its third panel. Then the outer edges of the blank are pushed to one side until the second and first panels respective lie atop the third and fourth panels and the thus refolded blank is pressed between a pair of horizonal rollers to compress the second and fourth creases. Then the blank is bent back and is again passed through a pair of horizontal rollers to flatten the first and third creases. This moves all of the creases through 180°, effectively breaking them in so that the blank can subsequently be opened up and handled fairly easily.

This breaking-in is, however, a step which represents a substantial problem in the production of such boxes. The suction belt that holds down the tube blanks requires a high-capacity blower and makes a lot of noise, so that noise-suppressing shields and the like must be installed. The speed of the breaking-in equipment must be set according to the box length and the speed of the sealing machine so that the breaking-in equipment must have its own adjustable drive.

OBJECTS OF THE INVENTION

It is therefore an object of the present invention to provide an improved system for breaking in box tube blanks.

Another object is the provision of such an improved system for breaking in box tube blanks which overcomes the above-given disadvantages, that is which is fairly simple, can operate with any length box synchronously with the sealing machine and which avoids the use of noisy apparatus.

SUMMARY OF THE INVENTION

A box tube blank having first, second, third, and fourth panels joined together at first, second, third, and forth creases is broken in starting with the blank oriented in a starting plane with the first and third creases superposed and the second and fourth creases outermost. First the second and fourth creases are pressed toward each other parallel to the starting plane to spread the first and third creases away from each other until the second and fourth creases are juxtaposed and the first and third creases lie outermost and the blank lies generally perpendicular to the starting plane. Then the tube blank passes between an upstream pair of parallel rollers extending perpendicular to the starting plane to compress it parallel to the starting plane. Thereafter the first and third creases are pressed toward each other perpendicular to the starting plane to spread the second and fourth creases away from each other until the first and third creases are juxtaposed and the second and fourth creases lie outermost and the blank lies generally parallel to the starting plane. The tube blank then passes between a downstream pair of parallel rollers extending parallel to the starting plane to compress it perpendicular to the starting plane.

In this manner each crease is folded through 180° and is compressed in both end positions. Hence the creases are effectively broken in and the blank can subsequently be handled fairly easily. The system uses no vacuum belt, with the attendant difficulties and noise, and can be set to operate on any width blank at any speed. In fact the drive for the breaking-in equipment can be taken directly off that of the upstream sealing equipment so they work perfectly synchronously.

According to the invention the starting plane downstream rollers are horizontal and the upstream rollers are vertical. Furthermore all the rollers are rotated at the same peripheral speed.

The breaking-in apparatus according to the invention has a set of downstream belts including a pair of downstream-converging belts having upstream ends spaced apart perpendicular to the starting plane by a distance equal generally to the dimension of the tube blank perpendicular to the starting plane as the tube blank exits from the upstream roller pair and downstream ends closely juxtaposed perpendicular to the starting plane. The downstream belt set further includes a pair of downstream-diverging belts having downstream ends spaced apart parallel to the starting plane by a distance equal generally to the dimension of the tube blank parallel to the starting plane as the tube blank enters the downstream roller pair and upstream ends closely juxtaposed parallel to the starting plane.

The breaking-in apparatus also includes a similar set of upstream belts oriented symmetrically, that is with the horizontally spaced belts converging downstream and the vertically spaced belts converging downstream. The belts are flat belts having outer faces formed with a central longitudinal crease-receiving groove.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
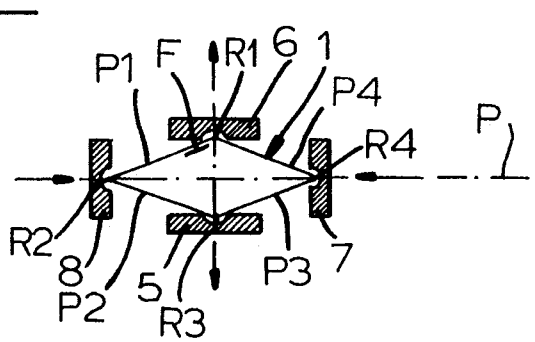
FIGS. 2 through 9 are schematic end views illustrating the steps of the method of the invention.

As seen in FIG. 2 a tube blank 1 has to start with four panels P1, P2, P3, and P4 of rectangular shape joined at creases R1, R2, R3, and R4. A flap F at the end of panel P4 is glued underneath the outer edge of panel P1. To start with, the blank is typically oriented with the first panel P1 lying on the second panel P2 and the third panel P3 underneath the fourth panel P4, the creases R2 and R4 being outermost and the crease R1 lying atop the crease R3.

Figure 1:
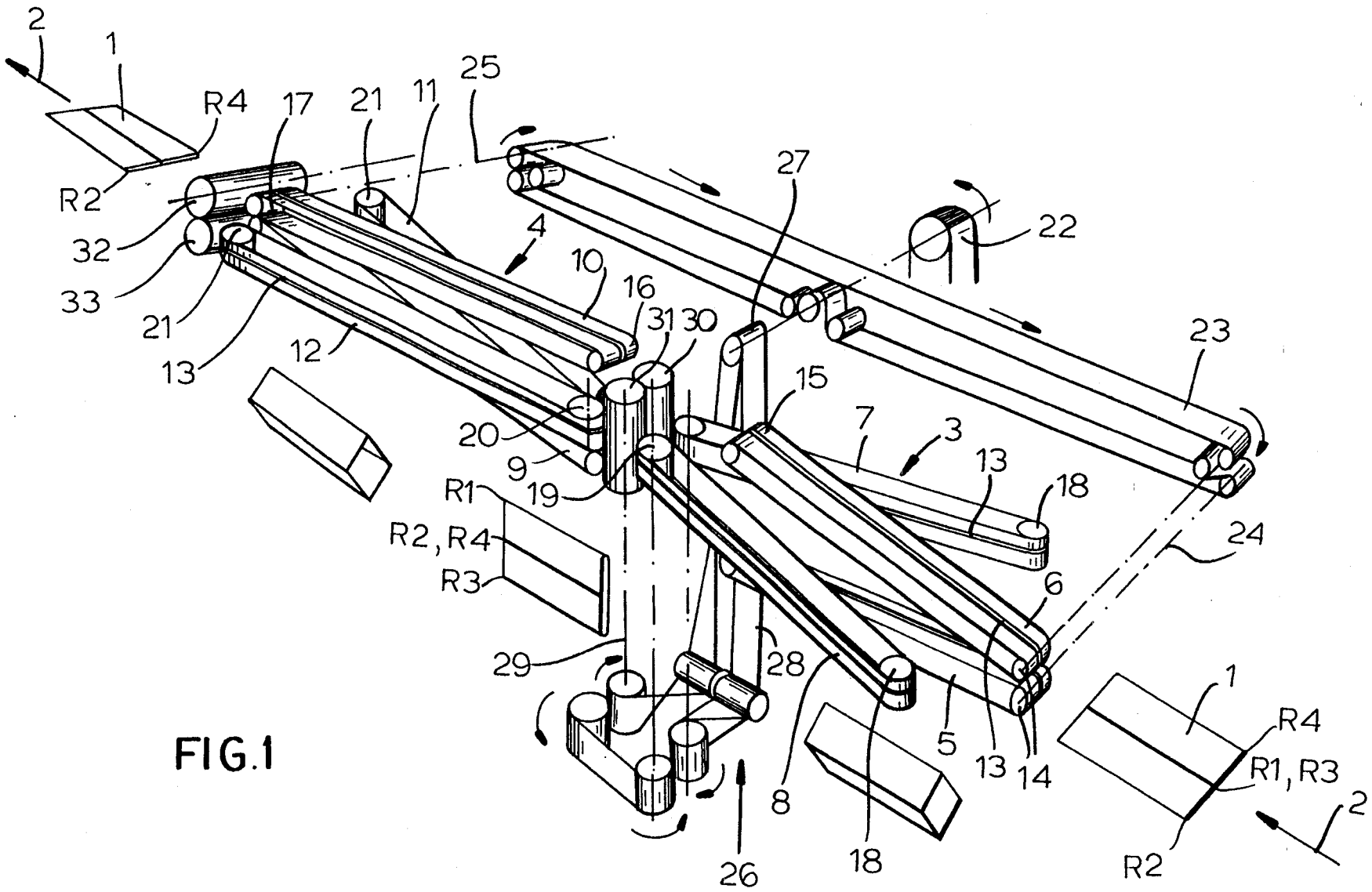
FIG. 1 is a mainly diagrammatic view illustrating the method and apparatus of this invention.

The apparatus shown in FIG. 1 comprises an upstream belt assembly 3, upstream pinch rollers 30 and 31, a downstream belt assembly 4, and downstream pinch rollers 32 and 33.

The upstream roller assembly 3 comprises a pair of downstream-diverging and vertically spaced belts 5 and 6 having upstream ends reeved over horizontal-axis and closely vertically juxtaposed rollers 14 and downstream ends reeved over horizontal and widely vertically spaced rollers 15. The assembly 3 further comprises a pair of downstream-converging and horizontally spaced belts 7 and 8 having upstream ends reeved over vertical-axis and widely horizontally spaced rollers 18 and downstream ends reeved over vertical and closely spaced rollers 19. The spacing between the rollers 15 and between the rollers 18 is generally equal to the width of the blank measured from crease R2 to crease R4 in the starting position while the rollers 14 and the rollers 19 are spaced so closely that they compress the flattened blank as will be described below when it passes between them.

The downstream roller assembly 4 comprises a pair of downstream-diverging and horizontally spaced belts 11 and 12 having upstream ends reeved over vertical-axis and closely horizontally juxtaposed rollers 20 and downstream ends reeved over horizontal and widely horizontally spaced rollers 21. The assembly 4 further comprises a pair of downstream-diverging and vertically spaced belts 9 and 10 having upstream ends reeved over horizontal-axis and widely spaced rollers 16 and downstream ends reeved over horizontal and closely spaced rollers 17. Each of the belts 5 through 12 is formed with a central outwardly open longitudinal groove 13.

A common drive belt 22, which is typically driven by the unillustrated upstream sealing machine, is connected to a belt 23 that in turn is connected as shown at 24 and 25 to the rollers 14 and 17 and also to the rollers 32 and 33. It also drives a roller 27 over which a right-angle belt 28 of a drive 26 is passed that is in turn connected as shown at 29 to the rollers 19 and 20 and also to the rollers 30 and 31.

Figure 3:
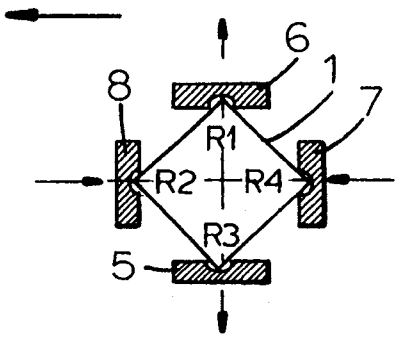
Figure 4:
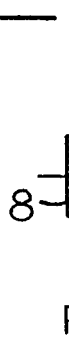
Figure 5:
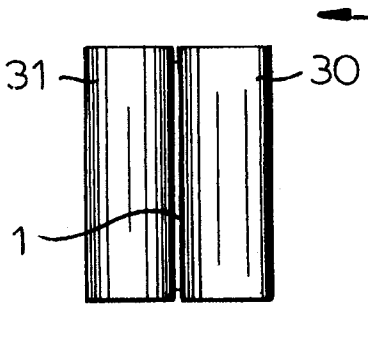

The system described above operates as follows:

To start with the blank 1 is fed in to the upstream end of the roller assembly 3 in a feed direction 2 in the above-described starting position in which it lies in a horizontal starting plane P. The creases R2 and R4 are engaged by the grooves 13 of the converging belts 7 and 8 as seen in FIG. 2 and are pressed horizontally together to force the creases R1 and R3 respectively upward and downward so they engage the grooves 13 of the belts 6 and 5. The converging belts 7 and 8 press the creases R2 and R4 together as shown by FIG. 3 until the blank 1, gripped only by the belts 7 and 8 which extend downstream past the ends of the belts 5 and 6, feed the thus vertically oriented blank 1 to the vertical compression rollers 30 and 31 as shown in FIG. 5. These rollers 30 flatten the creases R1 and R3.

Figure 6:
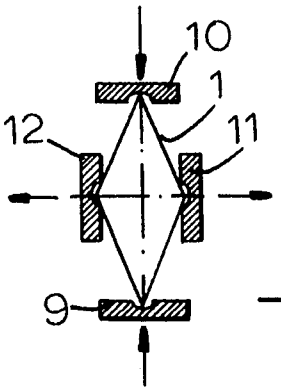
Figure 7:
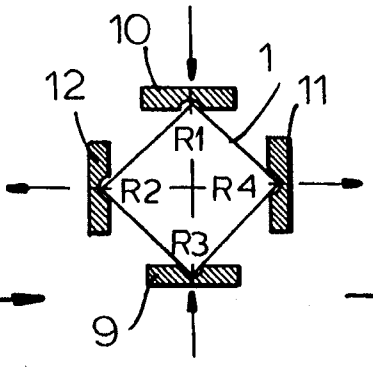
Figure 8:
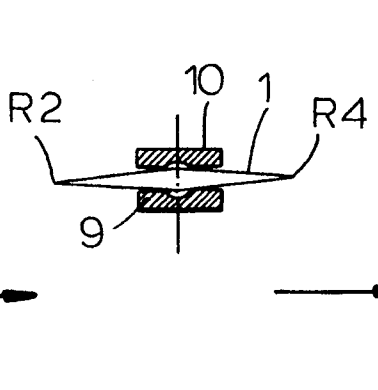
Figure 9:
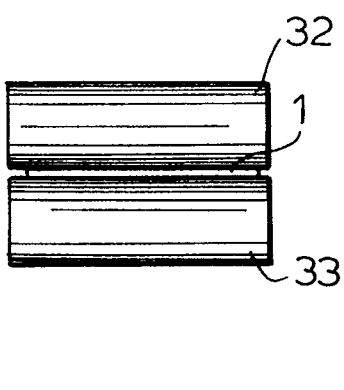

On exiting the rollers 30 and 31 as seen in FIG. 6, the creases R1 and R3 are engaged by the grooves 13 of the belts 9 and 10 which converge vertically to push the creases R2 and R4 horizontally outward into the grooves 13 of the belts 11 and 12. The converging belts 9 and 10 and diverging belts 11 and 12 then reverse the folding of the blank 1 as seen in FIG. 7 until it is held only between the belts 9 and 10 which, like the belts 7 and 8, extend downstream past the belts 11 and 12 as shown in FIG. 8. The belts 9 and 10 feed the thus refolded blank 1 into the horizontal nip between the downstream rollers 32 and 33 as seen in FIG. 9, where the creases R2 and R4 are flattened.

Thus each of the creases R1 through R4 has been folded and refolded through 180° and has been compressed in both positions. Subsequent opening of the thus broken-in blank 1 is therefore fairly easy.

I claim:

1. A method of breaking in a box tube blank having first, second, third, and fourth panels joined together at first, second, third, and fourth creases, the method comprising the steps, starting with the blank oriented in a starting plane with the first and third creases juxtaposed and the second and fourth creases spaced apart, of sequentially:

pressing the second and fourth creases toward each other parallel to the starting plane to spread the first and third creases away from each other until the second and fourth creases are juxtaposed and the first and third creases lie spaced apart and the blank lies generally perpendicular to the starting plane;

passing the tube blank between an upstream pair of parallel rollers extending perpendicular to the starting plane and compressing the tube blank between the upstream roller pair parallel to the starting plane;

pressing the first and third creases toward each other perpendicular to the starting plane to spread the second and fourth creases away from each other until the first and third creases are juxtaposed and the second and fourth creases lie spaced apart and the blank lies generally parallel to the starting plane; and passing the tube blank between a downstream pair of parallel rollers extending parallel to the starting plane and compressing the tube blank between the downstream roller pair perpendicular to the starting plane.

2. The breaking-in method defined in claim 1 wherein the starting plane downstream rollers are horizontal, the upstream rollers being vertical.

3. The breaking-in method defined in claim 1, further comprising the step of synchronously rotating all the rollers at the same peripheral speed and synchronously with a sealing machine.

4. An apparatus for breaking in a box tube blank having first, second, third, and fourth panels joined together at first, second, third, and fourth creases, the blank being oriented in a starting plane with the first and third creases juxtaposed and the second and fourth creases spaced apart, the apparatus comprising:

upstream means for pressing the second and fourth creases toward each other parallel to the starting plane to spread the first and third creases away from each other until the second and fourth creases are juxtaposed and the first and third creases lie spaced apart and the blank lies generally perpendicular to the starting plane;

means including an upstream pair of parallel rollers extending perpendicular to the starting plane immediately downstream of the upstream belts for receiving the tube blank and compressing it parallel to the starting plane;

means including a set of downstream belts immediately downstream of the upstream roller pair for receiving the tube blank pressing the first and third creases toward each other perpendicular to the starting plane to spread the second and fourth creases away from each other until the first and third creases are juxtaposed and the second and fourth creases lie spaced apart and the blank lies generally parallel to the starting plane; and a downstream pair of parallel rollers extending parallel to the starting plane immediately downstream of the downstream belts for receiving the tube blank and compressing it between the downstream roller pair perpendicular to the starting plane.

5. The breaking-in apparatus defined in claim 4 wherein the downstream belts include a pair of downstream-converging belts having upstream ends spaced apart perpendicular to the starting plane by a distance equal generally to the dimension of the tube blank perpendicular to the starting plane as the tube blank exits from the upstream roller pair and downstream ends closely juxtaposed perpendicular to the starting plane.

6. The breaking-in apparatus defined in claim 5 wherein the downstream belts further include a pair of downstream-diverging belts having downstream ends spaced apart parallel to the starting plane by a distance equal generally to the dimension of the tube blank parallel to the starting plane as the tube blank enters the downstream roller pair and upstream ends closely juxtaposed parallel to the starting plane.

7. The breaking-in apparatus defined in claim 4 wherein the upstream pressing means includes a set of upstream belts.

8. The breaking-in apparatus defined in claim 7 wherein the upstream belts include a pair of downstream-converging belts having upstream ends spaced apart parallel to the starting plane by a distance equal generally to the dimension of the tube blank parallel to the starting plane as the tube blank enters the downstream roller pair and downstream ends closely juxtaposed perpendicular to the starting plane.

9. The breaking-in apparatus defined in claim 8 wherein the downstream belts further include a pair of downstream-diverging belts having downstream ends spaced apart perpendicular to the starting plane by a distance equal generally to the dimension of the tube blank perpendicular to the starting plane as the tube blank enters the upstream roller pair and upstream ends closely juxtaposed perpendicular to the starting plane.

10. The breaking-in apparatus defined in claim 4 wherein the belts are flat belts having outer faces formed with a central longitudinal crease-receiving groove.

11. The breaking-in apparatus defined in claim 4, further comprising drive means for rotating the rollers synchronously at the same peripheral speed and for advancing the belts at the same speed synchronously with a sealing machine.

* * * * *